US007333124B2

(12) United States Patent
Nakata

(10) Patent No.: US 7,333,124 B2
(45) Date of Patent: Feb. 19, 2008

(54) THERMAL PRINTER

(75) Inventor: Hajime Nakata, Saitama (JP)

(73) Assignee: FUJIFILM Corporation, Tokyo (JP)

( * ) Notice: Subject to any disclaimer, the term of this patent is extended or adjusted under 35 U.S.C. 154(b) by 281 days.

(21) Appl. No.: 11/270,587

(22) Filed: Nov. 10, 2005

(65) Prior Publication Data

US 2006/0103714 A1 May 18, 2006

(30) Foreign Application Priority Data

Nov. 12, 2004 (JP) ..... 2004-329328

(51) Int. Cl.
*B41J 2/335* (2006.01)

(52) U.S. Cl. ..... 347/197; 400/120.16

(58) Field of Classification Search ..... 347/197; 400/120.16
See application file for complete search history.

(56) References Cited

U.S. PATENT DOCUMENTS 5,180,236 A * 1/1993 Kitahara et al. ..... 400/175
5,238,314 A * 8/1993 Kitahara et al. ..... 400/208

FOREIGN PATENT DOCUMENTS

JP 6-143652 A 5/1994

* cited by examiner

*Primary Examiner*—Huan Tran
(74) *Attorney, Agent, or Firm*—Sughrue Mion, PLLC

(57) ABSTRACT

In a thermal head, a heating element array is formed in a head substrate. Both ends of the head substrate are attached to a pair of support plates by a bolt. Plural pins protruding toward the head substrate are provided in the support plate. A gap is formed between the head substrate and the support plate through the pins. The gap prevents heat of the both ends of the head substrate from transferring to the support plate, and contributes to uniform the temperature in the overall length of the head substrate.

7 Claims, 5 Drawing Sheets

THERMAL PRINTER

BACKGROUND OF THE INVENTION

1. Field of the Invention

The present invention relates to a thermal printer, and more specifically to mounting structure of a thermal head.

2. Description of the Prior Arts

There has been known a thermal printer which records an image on a recording paper line by line with use of a thermal head while transporting the recording paper in a sub-scanning direction. The thermal head is provided with a head substrate and a heating element array provided in the head substrate. In the heating element array, plural heating elements are arranged along a main scanning direction. Both ends in the main scanning direction of the head substrate are held by a pair of support plates. Each heating element of the thermal head is driven in response to printing data to generate heat in accordance with recording density.

Heat energy generated from the heating element is partially transferred to the head substrate. The heat is further transferred to the support plate contacting with the both ends of the head substrate. As shown in FIG. 6, the temperature of the both ends of the thermal head (head substrate) tends to become lower than the central portion thereof. Accordingly, since the temperature of the head substrate is not uniform, there has been a problem that density unevenness is caused in the recorded image.

Japanese Patent Laid-Open Publication No. 6-143652 discloses a printer in which printing data is corrected based on virtual data that estimates heat quantity at the both ends of the thermal head. In this printer, the printing data is corrected in consideration of a temperature decrease at the both ends of the thermal head, so that the density unevenness in the recorded image caused by temperature unevenness in the head substrate is prevented.

However, since a memory for storing the virtual data and a correction circuit for correcting the printing data based on the virtual data are required, there is a problem that the printer is complicated to increase the cost.

SUMMARY OF THE INVENTION

An object of the present invention is to provide a thermal printer in which density unevenness in an image is prevented with a simple structure.

In order to achieve the above object, a thermal printer of the present invention is provided with a pair of support plates for supporting both ends in a main scanning direction of a head substrate, and spacers for creating gaps between the support plates and the both ends. The support plates and the both ends are connected by fixers.

According to the preferred embodiment of the present invention, the spacers are pins which are provided in either one of the head substrate or the support plates, and extend to the other. The pins also fit in concave portions formed in the other to position the thermal head with respect to the main scanning direction. The concave portions extend to a sub-scanning direction crosswise to the main scanning direction such that the pins can move in the sub-scanning direction when the position of the thermal head is adjusted.

BRIEF DESCRIPTION OF THE DRAWINGS

The above and other subjects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
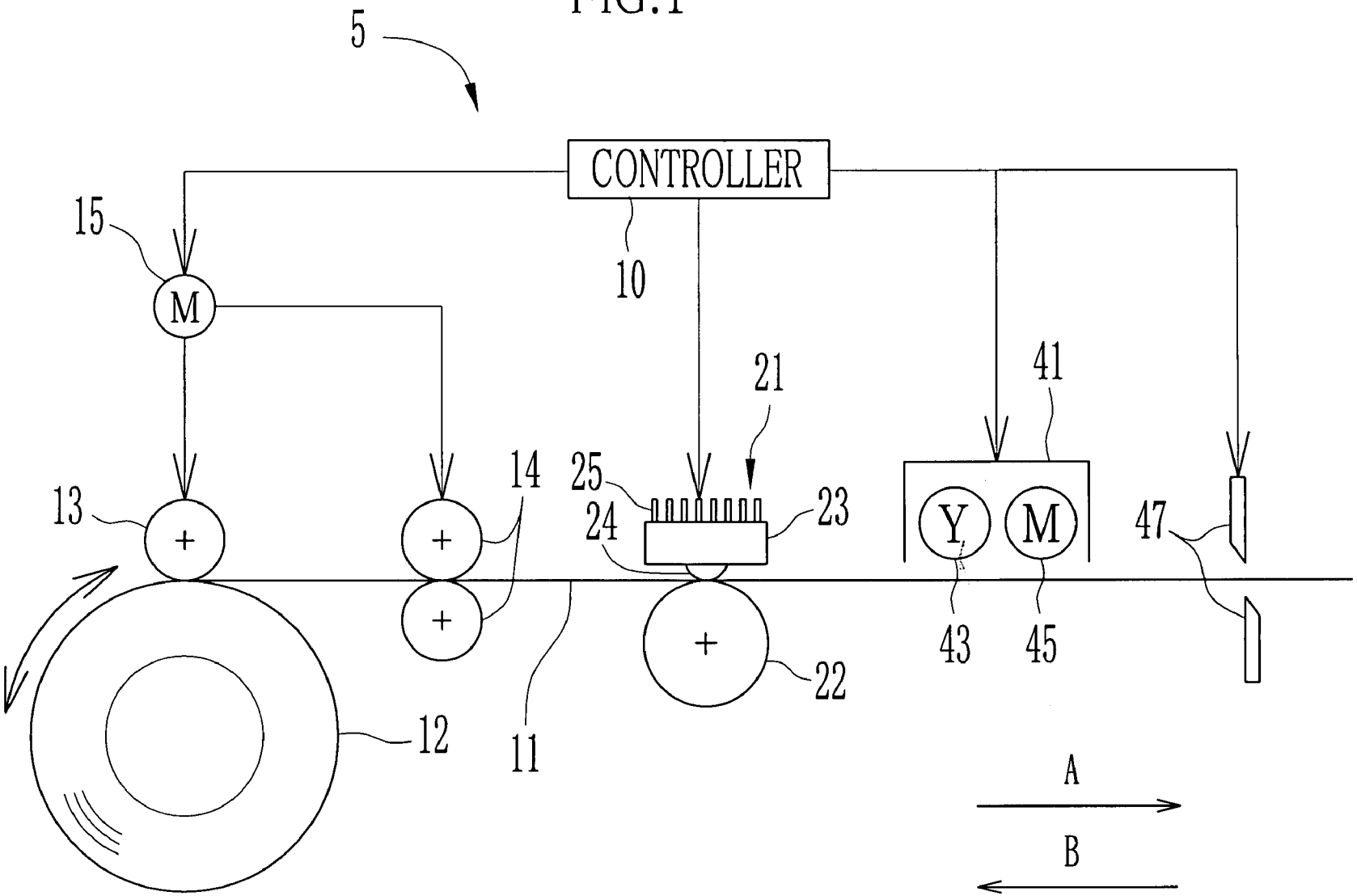
FIG. 1 is a schematic view showing a color thermal printer of the present invention.

In FIG. 1, a controller 10 overall controls each element of a color thermal printer (hereinafter a printer) 5. A continuous color thermal recording paper (hereinafter a recording paper) 11 is wound into a roll shape, and loaded into the printer 5 as a recording paper roll 12. The recording paper roll 12 is rotated by a feed roller 13 contacting with an outer periphery thereof to draw the recording paper 11 in a transporting path. The recording paper 11 is fed by a transport roller pair 14. The feed roller 13 and the transport roller pair 14 are driven by a drive motor 15.

While the recording paper 11 is reciprocally fed in A direction (advancing direction) and in B direction (withdrawing direction), yellow, magenta, and cyan images are thermally recorded and optically fixed.

As is well known, in the recording paper 11, three thermosensitive coloring layers, which respectively develop yellow, magenta, and cyan colors, are overlaid on a support in sequence from the top. A recording temperature of the yellow thermosensitive coloring layer, which is the uppermost layer, is the lowest of all these layers, while that of the cyan thermosensitive coloring layer, which is the lowermost layer, is the highest.

In order to prevent an uncolored portion of the recorded thermosensitive coloring layer from developing the color when the lower thermosensitive coloring layer is heated, optical fixation property of the light in a specific wavelength range is applied to each of the yellow and cyan thermosensitive coloring layers. The yellow thermosensitive coloring layer loses its coloring ability when violet-blue light, as yellow fixing light, of a wavelength peaking at about 420 nm is applied thereto. The magenta thermosensitive coloring layer loses its coloring ability when near-ultraviolet rays, as magenta fixing light, of a wavelength peaking at about 365 nm is applied thereto.

A thermal head 21 and a platen roller 22 are disposed on the transporting path of the recording paper 11. The platen roller 22 is disposed to face the thermal head 21, and supports the recording paper 11 from the rear face. The platen roller 22 moves downward when the recording paper 11 is fed in the A direction, to ensure a feeding path between the thermal head 21 and the platen roller 22. When the recording paper 11 is fed in the B direction, the platen roller 22 moves upward to hold the recording paper 11 with the thermal head 21.

A heating element array 24 in which a large number of heating elements are arranged linearly along a main scanning direction (a width direction of the recording paper 11) is provided on a bottom surface of the head substrate 23 of the thermal head 21. Each heating element emits heat energy corresponding to density of the color and the image to be printed, and thermally records the image in the specified coloring layer. A heat sink 25 is attached onto a top surface of the head substrate 23. The heat sink 25 is provided with plural fins extending to the main scanning direction, and dissipates the heat of the head substrate 23 accumulated in the image recording, to cool down the thermal head 21.

Figure 2:
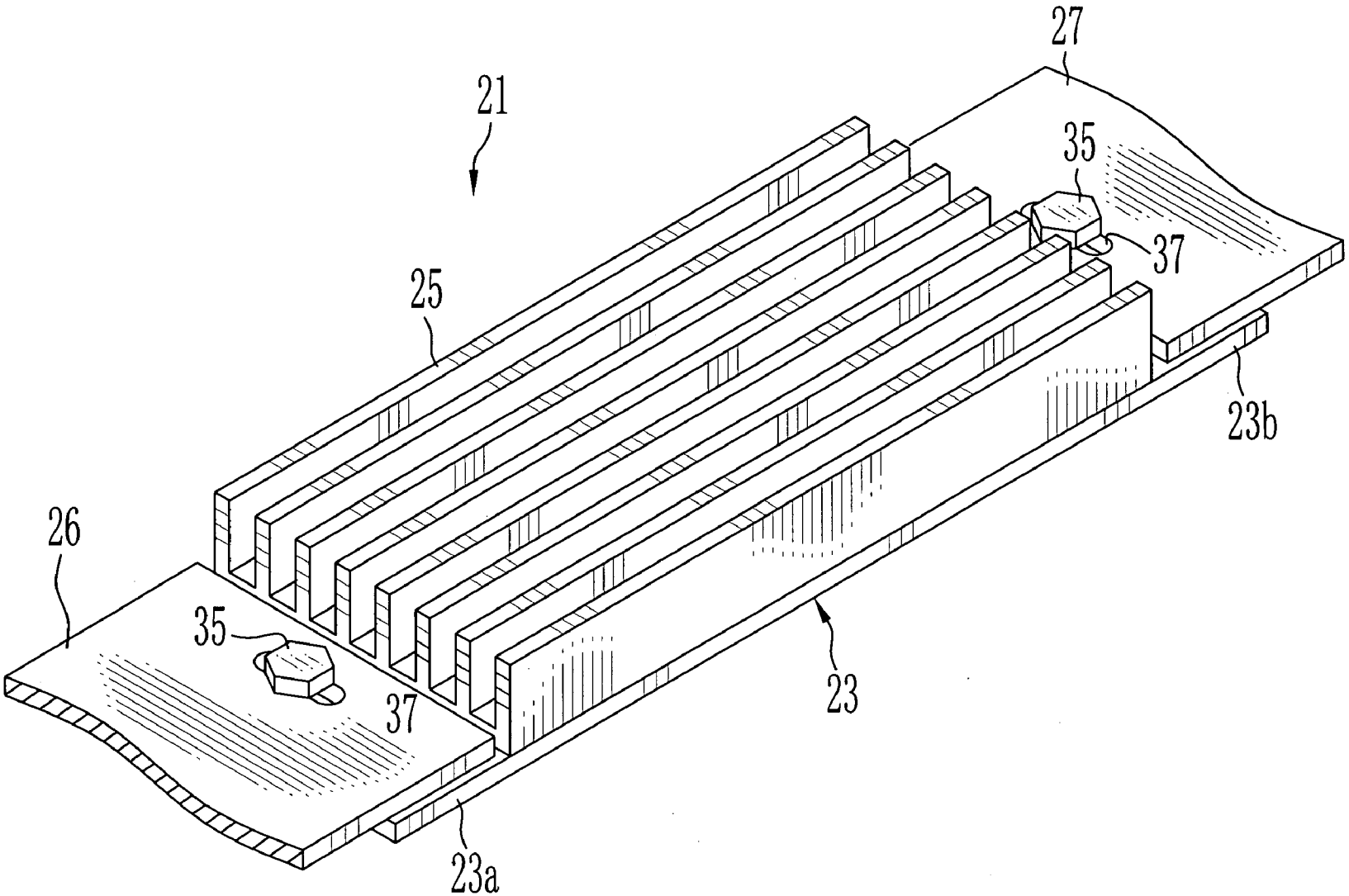
FIG. 2 is a perspective view showing a state in which both ends of a head substrate are respectively attached to each support plate.

As shown in FIG. 2, support plates 26,27, which are integrally formed with a chassis of the printer 5, are provided to face both ends 23*a*,23*b* in the main scanning direction of the head substrate 23. The both ends 23*a*,23*b* are respectively attached to the support plates 26,27 to support the thermal head 21 by the chassis.

Figure 3:
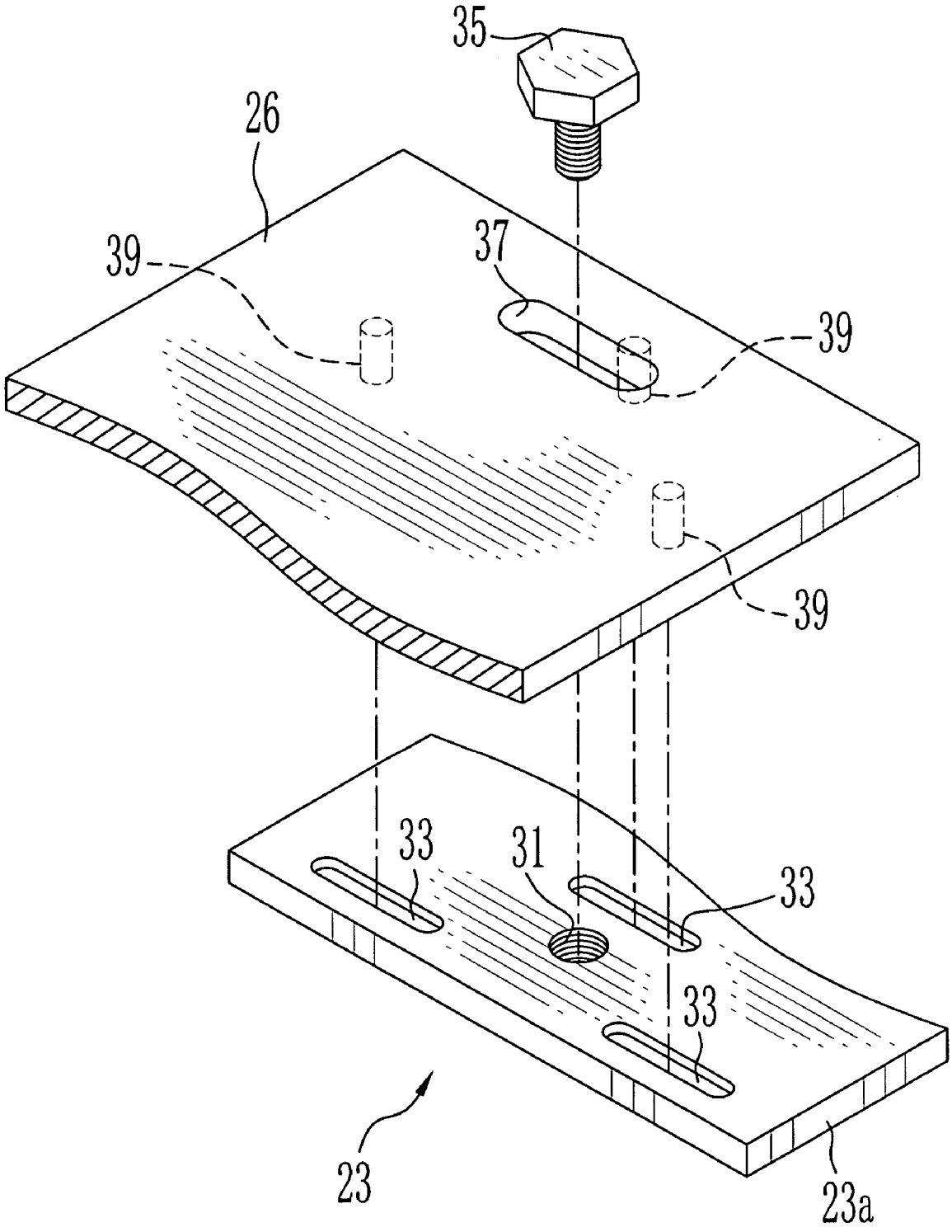
FIG. 3 is a top exploded perspective view of the end of the head substrate and the support plate.
Figure 4:
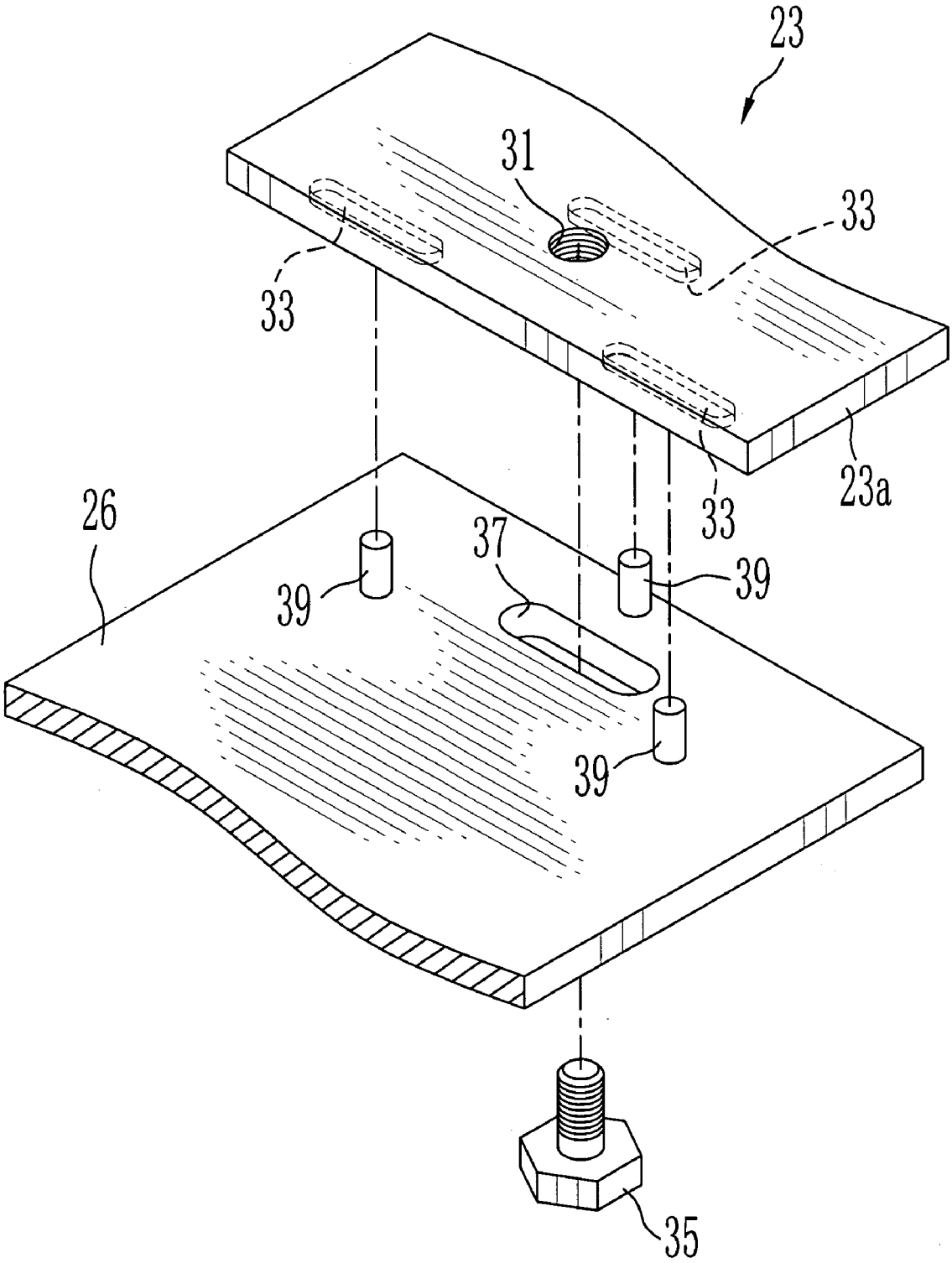
FIG. 4 is a bottom exploded perspective view of the end of the head substrate and the support plate.

As shown in FIGS. 3 and 4, a threaded hole 31 and concave portions 33 are formed in the end 23*a*. A bolt 35 is threadably mounted in the threaded hole 31. The concave portions 33 are formed on the bottom surface of the head substrate 23 and elongated in a sub-scanning direction. The support plate 26 is formed with an opening 37 and pins 39. The opening 37 is long in the sub-scanning direction, and a shaft portion of the bolt 35 penetrates therein. The pins 39 extend toward the head substrate 23, and are placed at corresponding positions to the concave portions 33. Diameter of each pin 39 is approximately equivalent to the length in the main scanning direction (width) of each concave portion 33, and the pins 39 are inserted into the concave portions 33.

The end 23*b* and the support plate 27 respectively have the same structure as the end 23*a* and the support 26. The end 23*b* is formed with the threaded hole 31 and the concave portions 33. The support 27 is provided with the opening 37 and the pins 39.

The thermal head 21 is put on the support plates 26,27, and the pins 39 fit in the concave portions 33. Thereby, the thermal head 21 is positioned in the main scanning direction. Since the opening 37 and the concave portions 33 extend in the sub-scanning direction, the thermal head 21 becomes able to slide in the sub-scanning direction, so that the position of the thermal head 21 can be adjusted with respect to the platen roller 22. After adjusting the position of the thermal head 21, the bolts 35 are fastened to fix the thermal head 21 firmly to the support plates 26,27.

Figure 5:
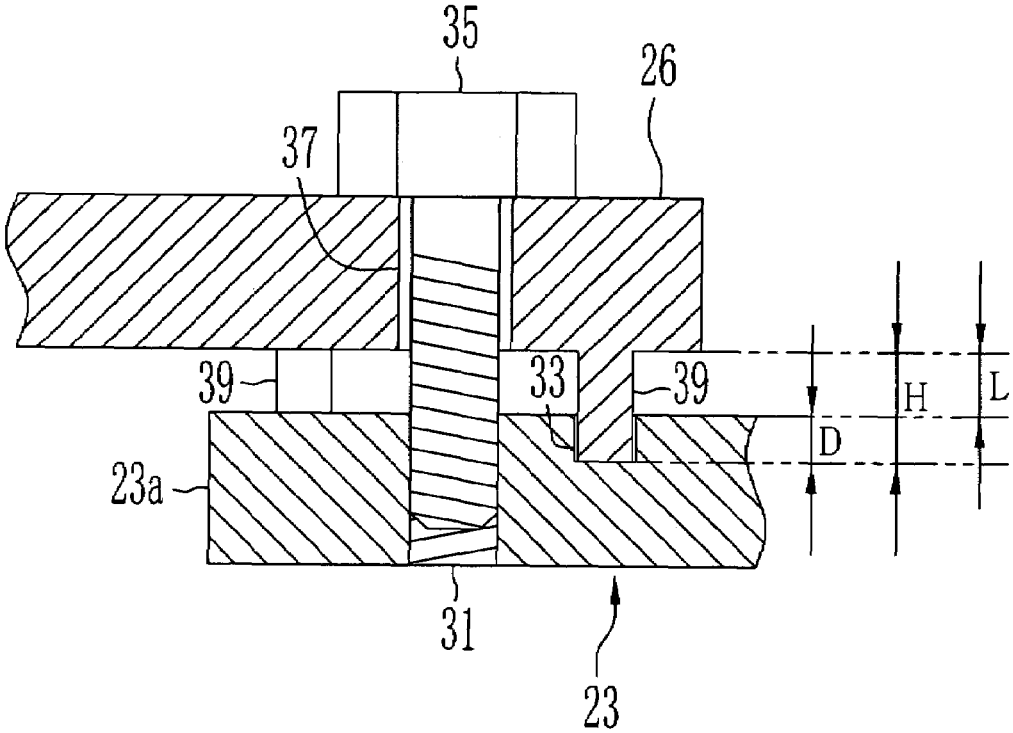
FIG. 5 is a cross-sectional view showing a state in which the head substrate is fixed to the support plate.
Figure 6:
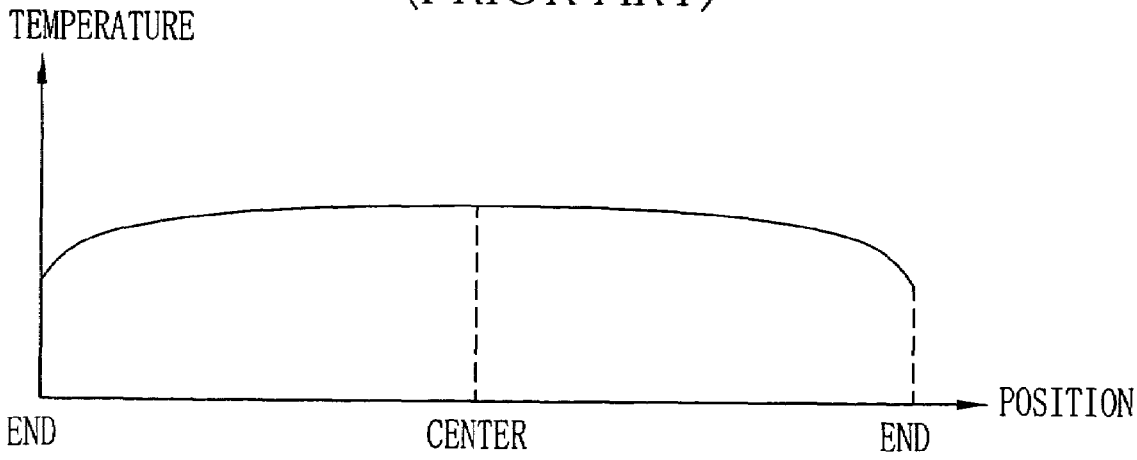
FIG.6 (PRIOR ART)
FIG. 6 is a graph showing a temperature distribution in a main scanning direction of a thermal head with the prior mounting structure.

When the ends 23*a*,23*b* are attached alose to the support plates 26,27, the heat of the ends 23*a*,23*b* is transferred to the support plates 26,27, and the temperature of the ends 23*a*, 23*b* is lowered (see FIG. 6). Therefore, the density of top and bottom of the image is lowered to cause the density unevenness in the recorded image. In the present invention, as shown in FIG. 5, each of the pin 39 is formed such that the height H exceeds the depth D of the concave portions 33. Accordingly, the pin 39 is operated as a spacer to create a gap having thickness of L between the end 23*a* and the support 26. Likewise, the gap having thickness of L is formed between the end 23*b* and the support plate 27. Thereby, the heat of the ends 23*a*,23*b* is transferred to the support plates 26,27 through the pins 39 and the bolts 35, so that the temperature decrease of the ends 23*a*,23*b* can be prevented.

In FIG. 1, an optical fixer 41 is disposed on the downstream side in the A direction. The optical fixer 41 is constituted of a yellow fixing lamp 43 emitting yellow fixing light and a magenta fixing lamp 45 emitting magenta fixing light. The yellow fixing lamp 43 is an ultraviolet ray lamp with the emission wavelength peaking at near 420 nm, and optically fixes the yellow thermosensitive coloring layer after recording. The magenta fixing lamp 45 is the ultraviolet ray lamp with the emission wavelength peaking at near 365 nm, and optically fixes the magenta thermosensitive coloring layer after recording.

A cutter 47 is provided in the downstream side of the optical fixer 41. The recording area of the recording paper 11 in which the thermal recording and the optical fixation are completed is sent to the cutter 47 to be cut into a sheet, and then discharged from the printer 5.

Next, the mounting of the thermal head is explained. When the printer 5 is assembled, the thermal head 21 is set so that the concave portions 33 engage with the pins 39, and positioned in the main scanning direction. Subsequently, the thermal head 21 is fixed to the support plates 26,27 by the bolts 35 after being positioned in the sub-scanning direction.

Next, print operation is explained. The feed roller 13 is rotated in accordance with a printing instruction to feed the recording paper 11 withdrawn from the recording paper roll 12 into the transporting path. The recording paper 11 is fed in the A direction by the transport roller pair 14. Subsequently, the transport roller pair 14 is rotated in the opposite direction to feed the recording paper 11 in the B direction. During the feeding of the recording paper 11, the recording paper 11 is pressed against the thermal head 21 by the platen roller 22. When the thermal head 21 heats the recording paper 11 in such a state, the yellow image is recorded line by line.

Since the head substrate 23 and the support plates 26,27 are separated from each other by the pins 39, the transfer of heat to the support plates 26,27 from the head substrate 23 is moderated. Thereby, the temperature of the both ends 23*a*,23*b* is not lowered, and the temperature in the overall length of the head substrate 23 is maintained uniform, so that the density unevenness does not occur in the image.

The platen roller 22 is retracted after recording the yellow image. Then, the recording paper 11 is fed in the A direction to pass through the optical fixer 41. During this passage, the yellow image is optically fixed by the yellow fixing lamp 43. After the optical fixation of the yellow image, the recording paper 11 is fed in the B direction. During the feeding, the thermal recording of the magenta image is started. Similar to the recording of the yellow image, the temperature of the thermal head 21 is maintained uniform, and the density unevenness in the image does not occur. While the recording paper 11 after the magenta image recording is fed in the A direction, the magenta image is optically fixed by the magenta fixing lamp 45.

After the optical fixation of the magenta image, while the recording paper 11 is fed in the B direction, the cyan image is thermally recorded thereon. The recording paper 11 after the cyan image recording is fed in the A direction to the cutter 47. The recording area is cut by the cutter 47 and discharged from the printer 5. The unrecorded recording paper 11 is withdrawn to the recording paper roll 12.

The temperature in the main scanning direction of the head substrate 23 is maintained uniform by forming the gaps between the head substrate 23 and the support plates 26,27, so that it is possible to prevent the density unevenness in the image caused by the temperature unevenness. Moreover, the use of the pins 39 can reduce the cost in comparison with the case wherein the printing data is corrected in consideration of the temperature decrease in the both ends of the head substrate.

Furthermore, the openings 37 for the bolt 35 and the concave portions 33 are elongated in the sub-scanning direction, so that it is possible to adjust easily the position of the thermal head in the sub-scanning direction. Additionally, the shape of the openings 37 and the concave portions 33 may be circle.

The number, shape, and arrangement of the pin and the concave portion are suitably determined according to the required strength. In the present invention, the pins are provided in the support plates, and the concave portions are provided in the head substrate; however, the concave portions may be provided in the support plates, and the pins may be provided in the head substrate. Moreover, only the pins may be provided. In this case, the gap is also formed between the printer body and the thermal head, so that the same effect as the above embodiment can be obtained. Alternatively, only the rim of the opening 37 may be stretched downward, so that the rim can have contact with the support plate.

Moreover, instead of the pins and the concave portions, for example, a spacer made from a material having low heat conductivity may be disposed between the thermal head and the printer body.

Furthermore, a clamper for nipping the head substrate and the support plate from the both sides may be used as the fixer. In this case, the damper has an E-like shape, and its central plate will be inserted, as the spacer, between the head substrate and the support plate. The E-like shape can integrate the spacer into the fixer.

In the above embodiment, although the color direct thermal printer, in which the color thermal recording paper is used, is explained as the example, the present invention can be also applied to a thermal printer of a thermal transfer type in which an ink sheet is heated by the thermal head to record the image by thermally transferring the ink to the recording paper.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A thermal printer having a thermal head in which a heating element array is provided on a head substrate comprising:

a pair of support plates facing both ends in a main scanning direction of said head substrate;

spacers for creating gaps between said support plates and said both ends; and fixers for fixing said both ends to said support plates.

2. A thermal printer as claimed in claim 1, wherein said spacers are pins provided in either one of said both ends or said support plates, and having contact with the other.

3. A thermal printer as claimed in claim 2, further comprising: concave portions formed in said other, said pins being fitted in said concave portions.

4. A thermal printer as claimed in claim 3, wherein said concave portions extend to a sub-scanning direction crosswise to said main scanning direction, said pins are able to move within said concave portions when a position of said thermal head is adjusted in said sub-scanning direction.

5. A thermal printer as claimed in claim 2, wherein said fixers are bolts.

6. A thermal printer as claimed in claim 5, wherein threaded holes threadably engaging with said pins are formed in either one of said both ends or said support plates, and openings into which shafts of said bolts penetrate are formed in the other.

7. A thermal printer as claimed in claim 6, wherein said openings are elongated in said sub-scanning direction.

* * * * *